US012607121B2

(12) United States Patent
Li et al.

(10) Patent No.: US 12,607,121 B2
(45) Date of Patent: Apr. 21, 2026

(54) STATIC CRUSHING DIRECTIONAL ANCHOR WITHDRAWAL METHOD AT END OF LARGE-MINING-HEIGHT WORKING FACE

(71) Applicant: Huating Coal Group Co., Ltd., Pingliang City (CN)

(72) Inventors: Xuandong Li, Pingliang City (CN); Jinsheng Ma, Pingliang City (CN); Zhihong Song, Pingliang City (CN); Lingyun Li, Pingliang City (CN); Chao Gao, Pingliang City (CN); Peng Li, Pingliang City (CN); Fuqi Wang, Pingliang City (CN); Yuanda Ren, Pingliang City (CN); Longfei Wang, Pingliang City (CN); Hua Zhang, Pingliang City (CN); Jiangning Wang, Pingliang City (CN); Xiaogang Li, Pingliang City (CN); Huiqiang Zhao, Pingliang City (CN); Zhixiang Li, Pingliang City (CN); Jun Wu, Pingliang City (CN); Bin Tian, Pingliang City (CN); Bin Zheng, Pingliang City (CN); Dongdong Wang, Pingliang City (CN); Wenfei Rui, Pingliang City (CN)

(73) Assignee: Huating Coal Group Co., Ltd., Pingliang City (CN)

( * ) Notice: Subject to any disclaimer, the term of this patent is extended or adjusted under 35 U.S.C. 154(b) by 63 days.

(21) Appl. No.: 18/322,101

(22) Filed: May 23, 2023

(65) Prior Publication Data

US 2024/0076985 A1 Mar. 7, 2024

(30) Foreign Application Priority Data

Sep. 2, 2022 (CN) ..... 202211070280.4

(51) Int. Cl.
*E21C 41/18* (2006.01)
*E21D 9/00* (2006.01)

(52) U.S. Cl.
CPC ..... *E21C 41/18* (2013.01); *E21D 9/001* (2013.01)

(58) Field of Classification Search
CPC ..... E21C 41/18; E21D 9/001
See application file for complete search history.

(56) References Cited

FOREIGN PATENT DOCUMENTS

CN 104533452 B * 8/2016 ..... E21B 33/13

* cited by examiner

*Primary Examiner* — Janine M Kreck
(74) *Attorney, Agent, or Firm* — Edell, Shapiro & Finnan, LLC

(57) ABSTRACT

A static crushing directional anchor withdrawal method at the end of a large-mining-height working face is provided. The method includes the following steps: designing key parameters of boreholes for static crushing, including a borehole position, a spacing between boreholes, a borehole depth, and a borehole diameter at the end of a working face; then determining parameters of a static crushing agent grouting technology device for the construction of a static crushing process; and carrying out an anchor withdrawal operation at the end. The method can solve the problem of difficult roof anchor withdrawal at the end of a working face, is beneficial to shortening the hanging roof distance of the working face, preventing the sudden caving of hanging roofs at the upper and lower corners of the working face and the potential safety hazard caused by gas overrun, and guaranteeing the normal use of the mining roadway.

5 Claims, 8 Drawing Sheets

STATIC CRUSHING DIRECTIONAL ANCHOR WITHDRAWAL METHOD AT END OF LARGE-MINING-HEIGHT WORKING FACE

CROSS-REFERENCE TO RELATED APPLICATION

This patent application claims the benefit and priority of Chinese Patent Application No. 202211070280.4, filed with the China National Intellectual Property Administration on Sep. 2, 2022, the disclosure of which is incorporated by reference herein in its entirety as part of the present application.

TECHNICAL FIELD

The present disclosure belongs to the technical field of coal mining, and in particular to a static crushing directional anchor withdrawal method at the end of a large-mining-height working face.

BACKGROUND

With the advancement of the working face, the mining roadway behind the working face becomes a part of the gob area. Before the hanging roof appears in the working face, anchor rods and their riggings at the roof are dismantled, making the roof cave naturally due to the loss of support. As anchors on the roof of most mining roadways are affected by dynamic pressure and various factors, anchor withdrawal tools are difficult to achieve ideal anchor withdrawal effect, and a large number of anchor cables cannot be dismantled, and most anchors of the anchor cables still play the role of hanging and strengthening the roof after anchor withdrawal, resulting in the failure of in-time caving of the arc triangle area of the roof at the end of the mining roadway, and the existence of many hidden dangers.

It is a common problem faced by the working face that the roof behind the end cannot cave in time. The weight of roof and overlying strata is applied to coal pillars, leading to serious deformation of coal pillars and increase of roadway support cost of the working face. Rapid pressurization caused by large-area caving of the hanging roof forms a certain impact on the working face, affecting the normal production of the working face and the safe use of equipment. Triangle area formed by the hanging roof is a dead corner of ventilation, at which a large amount of gas is often accumulated. The gas may suddenly pour into the stope face and gateway at the moment when the hanging roof breaks, causing gas overrun and affecting normal production. At the moment of roof caving, the collision of rocks may produce sparks, which may result in gas accidents and has great potential harm.

At present, the mechanized anchor withdrawal method has some shortcomings, such as pulling by force, leading to the increase of the roof caving risk and poor anchor withdrawal effect. The chemical reagent anchor withdrawal cannot completely make anchor cables fail and has certain risks. Therefore, it is necessary to invent a safe and efficient method to solve the above problems.

SUMMARY

For the problem of hanging roof in the arc triangle area caused by poor anchor withdrawal effect at the end of the working face and the deficiency IN the prior art, a static crushing directional anchor withdrawal method at the end of a working face is provided, which is convenient for anchor withdrawal operation, beneficial to the roof caving at the end of the working face, and can shorten the hanging roof area.

The present disclosure employs the following solution:

A static crushing directional anchor withdrawing method at the end of a large-mining-height working face includes the following steps:

Step 1, Parameters of boreholes for static crushing are designed

Borehole position: The boreholes are located in a triangle area of the roof end, arranged around an anchor cable, and provided along a gateway strike. The arrangement mode of the boreholes can be properly adjusted according to field conditions: when two anchor cables are provided in the same row, four static crushing agent charging boreholes are arranged in front and behind the anchor cables, and an auxiliary borehole is provided between the two anchor cables; and when three anchor cables are provided in the same row, four static crushing agent charging boreholes are arranged in front and behind the anchor cables, and an auxiliary borehole is provided on each of both sides close to the coal wall.

Borehole diameter: the borehole diameter is from 48 mm to 65 mm.

Borehole angle: the borehole is drilled perpendicular to the roof.

Borehole depth: the borehole depth is consistent with the length of a roof anchor cable.

Analysis of a spacing between boreholes: according to the propagation range of wall rock cracks when a static crushing agent acts, determining a spacing between the boreholes.

Step 2: Parameters of a static crushing agent grouting technology are designed

The static crushing agent is prepared from the following components: based on raw material components such as hydration expansive substances, hydration retarders, hydraulic cementing substances and water reducers, the water-cement ratio of the static crushing agent is 1:3.

The mass of the static crushing agent required for each borehole is calculated according to the following formula:

$$Q = K\pi\gamma\left(\frac{\Phi}{2}\right)^2(s - s_1),$$

where K is a grouting coefficient 1.4-1.5; $\gamma$ is bulk density of the material, g/cm$^3$; $\Phi$ is the borehole diameter, m; s is the borehole depth, m; $s_1$ is borehole sealing length, m; and Q is the mass of the crushing agent for each borehole, Mg (mega-grams).

The static crushing agent is grouted by a pneumatic double-liquid grouting pump, with the use of a tee pipe.

A borehole packer is selected from one having a diameter of 50 mm, the borehole sealing range of 55 mm to 100 mm, and a working pressure of 5 MPa to 7 MPa, or the one having a diameter of 38 mm, the borehole sealing range of 43 mm to 55 mm, and a working pressure of 5 MPa to 7 MPa.

The static crushing agent is stirred with a stirring barrel, where the stirring barrel has the capacity of 80 L, a rated air pressure of 0.6 MPa, a blade torque of 150 N·m, length×width×height of 0.5 m×0.5 m×1.0 m, and a weight of 120 kg.

Step 3: The static crushing agent grouting technology includes the following steps:

a: Prior to the implementation of drilling and grouting operation, in order to guarantee the safety of personnel and equipment during the construction, it is necessary to carry out "wall tapping and roof sounding", to check whether the position of a conveyer is suitable, and migrate the conveyor if the position is unsuitable, and to make a construction area unobstructed within 5 m. Then construction equipment, such as an air duct and grouting pump, is debugged to ensure that the air duct is free from air leakage and blockage, and the parameters such as the lift and rotating speed of the grouting pump are in the normal range.

b. Within 5 m distance from the roof to be treated, a temporary support is erected by means of piling column, where the region and position of the temporary support should be appropriate to reserve enough operating space for the construction equipment and personnel. After erecting the temporary support, the roof is drilled according to a design scheme. The drilling is started at a low drilling speed, and with the increase of the borehole depth, the drilling speed is adjusted to the optimum speed suitable for roof drilling until a drill rod is in place. Before the drill rod descends to leave the hole, a protective handrail is held by another person to ensure the stability of a drilling rig; and then the drill rod is replaced with a second drill pipe to complete the final drilling.

c. The borehole sealing technology is carried out with a borehole packer, the borehole packer is inserted prior to grouting, with a borehole sealing depth of 0.5 m; then overlying strata on the roof show signs of movement, and large cracks have appeared in the borehole. In order to ensure the grouting effect and save grouting materials, a flexible plastic sleeve is required to be placed in the borehole before the borehole packer is inserted, and then the borehole packer is placed into the sleeve. The borehole packer is completely inserted into the borehole, and then a grouting pipeline of the pneumatic grouting pump is connected to an exposed joint of the borehole packer. Under a certain grouting pressure, a rubber hose of the borehole packer expands to achieve borehole sealing.

d. Water and a static crushing agent are mixed according to a weight ratio of 1:3, and then are stirred with a stirring barrel to form a uniform slurry with fluidity. It is necessary to ensure that the crushing agent is completely dissolved in water, and the slurry after stirring must be filled in the borehole within 10 min, otherwise, its fluidity and crushing effect may be obviously reduced.

e. Special personnel are assigned to prepare mixed static crushing slurry, and to control the stirring speed, thus shortening the slurry shelving time as much as possible. A filter screen is provided at a slurry suction port to prevent caking impurities and other sundries such as paper bags from entering the slurry. During pump injection, attention should be paid to observe the changes of roadway top slope and strictly control grouting pressure, thus preventing large-area cracking and falling off of the top slope caused by excessive grouting pressure. Single borehole must be charged at one time, and the boreholes in the same row should be charged at the same time as far as possible, thus achieving the superposition of expansion force generated by the reagent, and improving the expansion effect.

f. During the reaction of the static crushing agent, in order to prevent injury to underground passing personnel, special personnel should be appointed to set up warning signs at the positions 10 m in front and behind both ends of the construction area, and to monitor the reaction of the static crushing agent on site. If cracks are found and rocks fall off, personnel should be prohibited from passing immediately.

Step 4: An anchor withdrawal operation is implemented to withdrawn anchor rods and anchor cables in the arc triangle area of the roof at the end.

The present disclosure has the beneficial effects that:

1. The method is beneficial to the anchor withdrawal operation at the end of the working face, shortening the hanging roof distance of the triangle area of the roof at the end, and preventing the sudden caving of hanging roofs at the upper and lower corners of the working face and the potential safety hazard caused by gas overrun.
2. The static crushing technology has outstanding advantages such as no vibration, no flying stone, no shock wave, no noise, no toxic gas pollution, etc., and thus cannot affect the normal production tasks or plans of the working face, and ensure efficient and safe mining of the working face.

Figure 1:
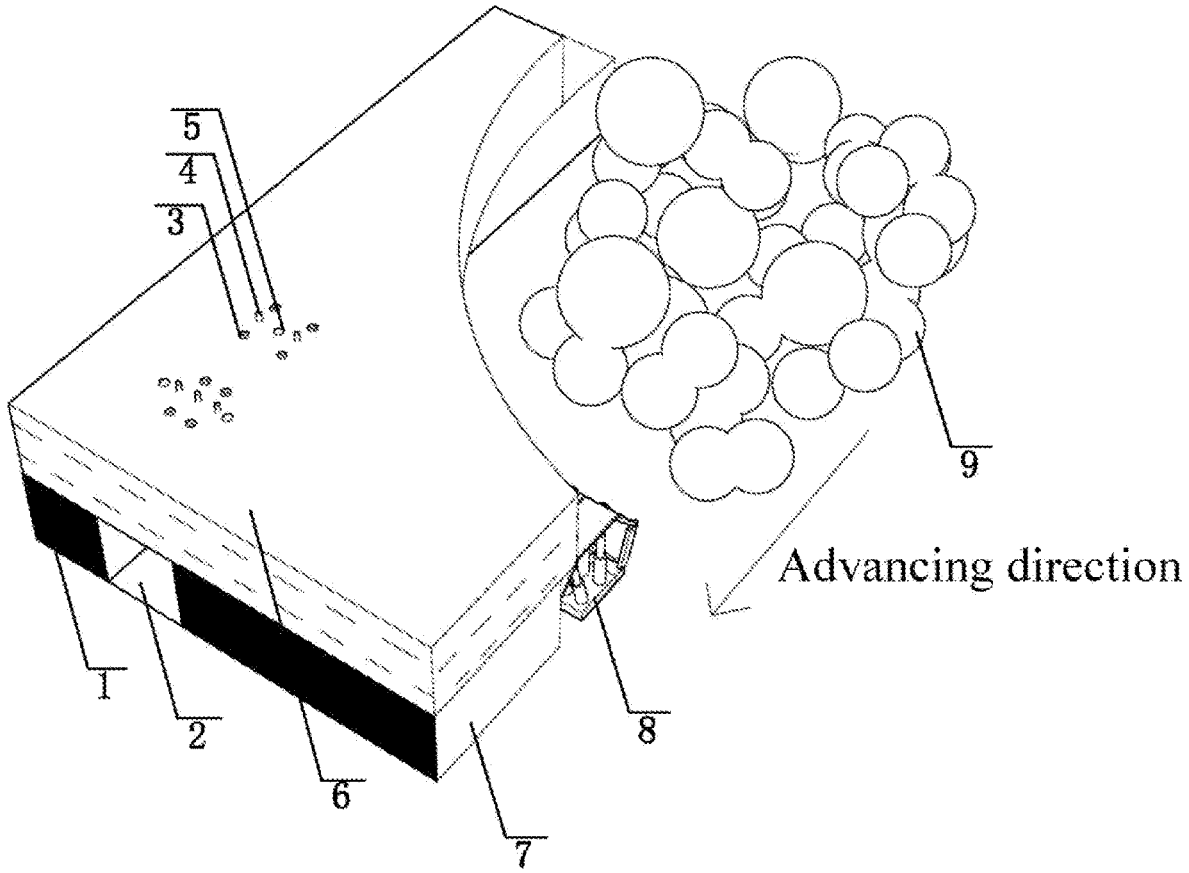
FIG. 1 is a schematic diagram of boreholes on a roof at the end of a working face end.
Figure 2:
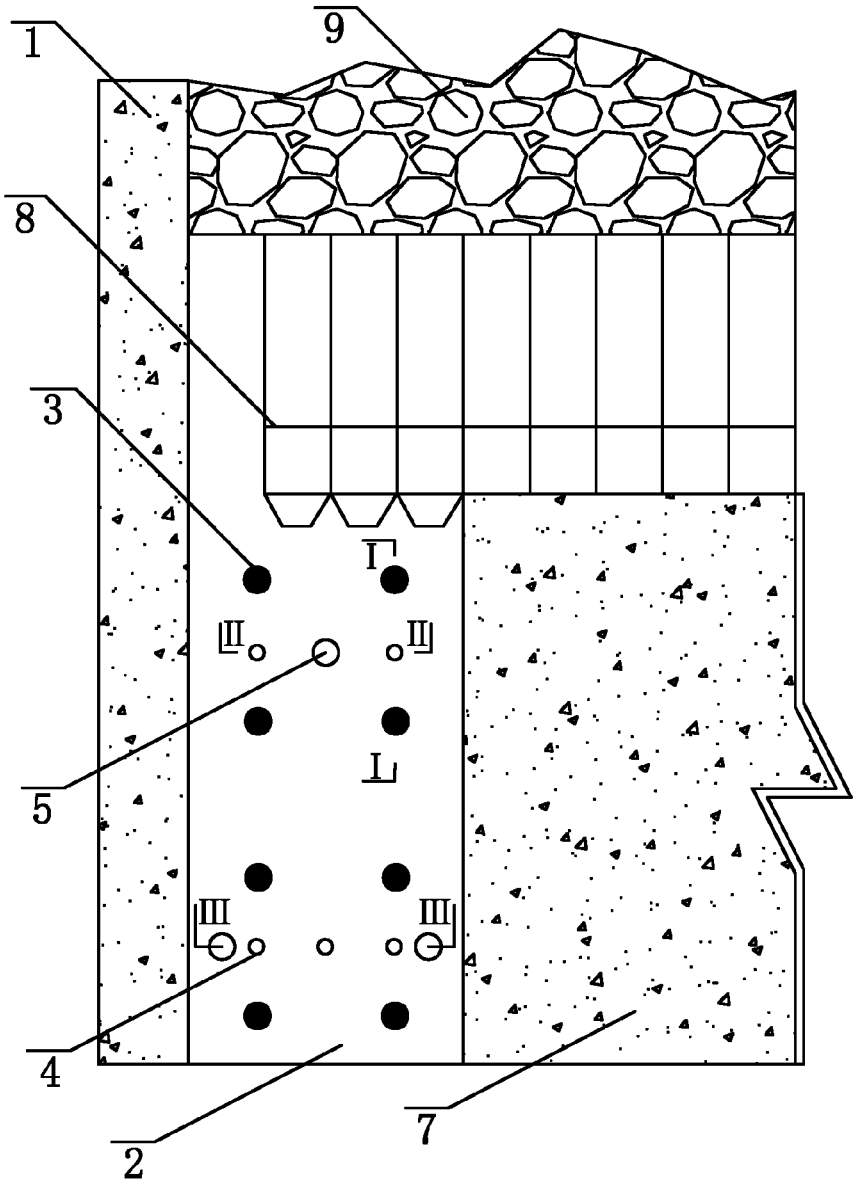
FIG. 2 is a top view of boreholes on a roof at the end of a working face.
Figure 3:
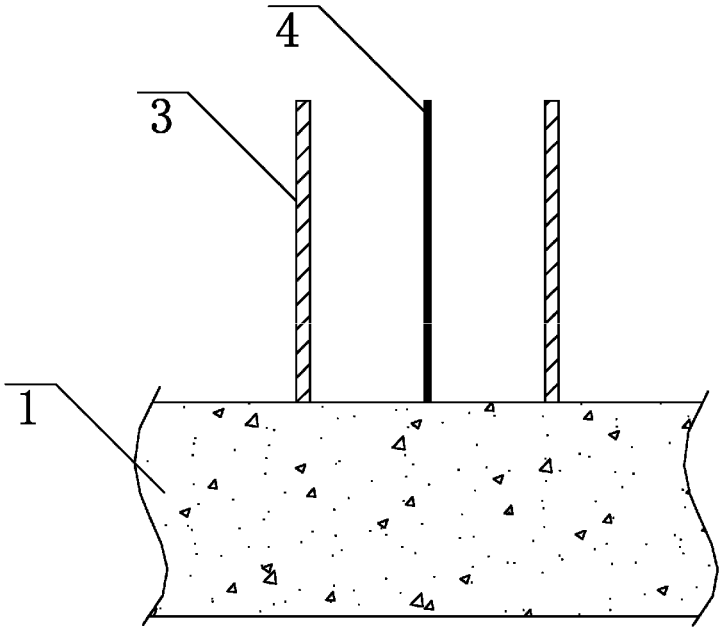
FIG. 3 is a sectional view of a section I-I in FIG. 2.

In the drawings: 1—gateway coal pillar; 2—gateway; 3—static crushing agent borehole; 4—anchor cable; 5—axiliary borehole; 6—arc triangle area of roof, 7—working face; 8—hydraulic support; 9—gob area; 10—static crushing agent; 11—borehole packer; 12—flexible plastic sleeve; 13—stirring barrel; 14—tee pipe; 15—pneumatic double-liquid grouting pump; 16—orifice sealing section; 17—propagated crack on wall rock of borehole.

DETAILED DESCRIPTION

The present disclosure is further described below with reference to the accompanying drawings.

In FIG. 1 through FIG. 10, a static crushing anchor withdrawal technology is analyzed from different angles. A static crushing directional anchor withdrawal method at the end of a large-mining-height working face provided by the present disclosure is carried out according to the following steps:

(1) Key parameters of boreholes for static crushing are designed

Borehole position: The boreholes are located in a triangle area of the roof end, arranged around an anchor cable, and provided along a gateway strike The arrangement mode of the boreholes can be properly adjusted according to field conditions: when two anchor cables are provided in the same row, four static crushing agent charging boreholes are arranged in front and behind the anchor cables, and an auxiliary borehole is provided between the two anchor cables; and when three anchor cables are provided in the same row, four static crushing agent charging boreholes are arranged in front and behind the anchor cables, and an auxiliary borehole is provided on each of both sides close to the coal wall.

Borehole diameter: the borehole diameter is from 48 mm to 65 mm.

Borehole angle: the borehole is drilled perpendicular to the roof.

Borehole depth: the borehole depth is consistent with the length of a roof anchor cable.

Analysis of a spacing between boreholes: according to the propagation range of wall rock cracks when a static crushing agent acts, determining a spacing between the boreholes.

Step 2: Parameters of a static crushing agent grouting technology are designed

The static crushing agent is prepared from the following components: based on raw material components such as hydration expansive substances, hydration retarders, hydraulic cementing substances and water reducers, a water-cement ratio of the static crushing agent is 1:3 (i.e., the mass ratio of the water to the static crushing agent).

The mass of the static crushing agent required for each borehole is calculated according to the following formula:

$$Q = K\pi\gamma\left(\frac{\Phi}{2}\right)^2(s - s_1),$$

where K is a grouting coefficient 1.4-1.5; $\gamma$ is bulk density of the material, g/cm$^3$; $\Phi$ is the borehole diameter, m; s is the borehole depth, m; $s_1$ is borehole sealing length, m; and Q is the mass of the crushing agent for each borehole, Mg (mega-grams).

The static crushing agent is grouted by a pneumatic double-liquid grouting pump, with the use of a tee pipe.

A borehole packer is selected from one having a diameter of 50 mm, the borehole sealing range of 55 mm to 100 mm, and a working pressure of 5 MPa to 7 MPa, or the one having a diameter of 38 mm, the borehole sealing range of 43 mm to 55 mm, and a working pressure of 5 MPa to 7 MPa.

The static crushing agent is stirred with a stirring barrel, where the stirring barrel has the capacity of 80 L, a rated air pressure of 0.6 MPa, a blade torque of 150 N·m, length×width×height of 0.5 m×0.5 m×1.0 m, and a weight of 120 kg.

Step 3: The static crushing agent grouting technology includes the following steps:

a: Prior to the implementation of drilling and grouting operation, in order to guarantee the safety of personnel and equipment during the construction, it is necessary to carry out "wall tapping and roof sounding", to check whether the position of a conveyer is suitable, and migrate the conveyor if the position is unsuitable, and to make a construction area unobstructed within 5 m. Then construction equipment, such as an air duct and grouting pump, is debugged to ensure that the air duct is free from air leakage and blockage, and the parameters such as the lift and rotating speed of the grouting pump are in the normal range.

b. Within 5 m distance from the roof to be treated, a temporary support is erected by means of piling column, where the region and position of the temporary support should be appropriate to reserve enough operating space for the construction equipment and personnel. After erecting the temporary support, the roof is drilled according to a design scheme. The drilling is started at a low drilling speed, and with the increase of the borehole depth, the drilling speed is adjusted to the optimum speed suitable for roof drilling until a drill rod is in place. Before the drill rod descends to leave the hole, a protective handrail is held by another person to ensure the stability of a drilling rig; and then the drill rod is replaced with a second drill pipe to complete the final drilling.

c. The borehole sealing technology is carried out with a borehole packer, the borehole packer is inserted prior to grouting, with a borehole sealing depth of 0.5 m; then overlying strata on the roof show signs of movement, and large cracks have appeared in the borehole. In order to ensure the grouting effect and save grouting materials, a flexible plastic sleeve is required to be placed in the borehole before the borehole packer is inserted, and then the borehole packer is placed into the sleeve. The borehole packer is completely inserted into the borehole, and then a grouting pipeline of the pneumatic grouting pump is connected to an exposed joint of the borehole packer. Under a certain grouting pressure, a rubber hose of the borehole packer expands to achieve borehole sealing.

d. Water and a static crushing agent are mixed according to a weight ratio of 1:3, and then are stirred with a stirring barrel to form a uniform slurry with fluidity. It is necessary to ensure that the crushing agent is completely dissolved in water, and the slurry after stirring must be filled in the borehole within 10 min, otherwise, its fluidity and crushing effect may be obviously reduced.

e. Special personnel are assigned to prepare mixed static crushing slurry, and to control the stirring speed, thus shortening the slurry shelving time as much as possible. A filter screen is provided at a slurry suction port to prevent caking impurities and other sundries such as paper bags from entering the slurry. During pump injection, attention should be paid to observe the changes of roadway top slope and strictly control grouting pressure, thus preventing large-area cracking and falling off of the top slope caused by excessive grouting pressure. Single borehole must be charged at one time, and the boreholes in the same row should be charged at the same time as far as possible, thus achieving the superposition of expansion force generated by the reagent, and improving the expansion effect.

f. During the reaction of the static crushing agent, in order to prevent injury to underground passing personnel, special personnel should be appointed to set up warning signs at the positions 10 m in front and behind both ends of the construction area, and to monitor the reaction of the static crushing agent on site. If cracks are found and rocks fall off, personnel should be prohibited from passing immediately.

Step 4: An anchor withdrawal operation is implemented to withdrawn anchor rods and anchor cables in the arc triangle area of the roof at the end.

The method of the present disclosure is illustrated by specific examples.

Embodiment 1

As shown in FIG. 1, the average thickness of No. 4 coal seam in a mine is 5.6 m, and the coal seam structure is blocky and strip-shaped, with semi-hard coal briquettes, developed joints and simple coal seam structure. The working face has a strike length of 1,850 m and an inclined length of 231 m. A strike long-wall retreating mining method and fully-mechanized mining process for full-seam mining are employed, and a full caving method is used for roof management. There is a false roof in the coal seam roof, with a thickness of 0.67 m, which is dark brown carbonaceous mudstone. An immediate roof is thin-layered mudstone with horizontal bedding, and has a thickness of 3.39 m. A main roof is fine-grained sandstone and medium-grained sandstone with a thickness of 6.10 m. An immediate floor is flaky mudstone with poor stability, and has a thickness of 4.44 m. The mining face belongs to large mining height, a gateway 2 has a height of 4.35 m, a width of 5 m and large wall-rock deformation, which is mainly manifested as roof subsidence, floor heave and side heave. During the mining of the working face, due to the fact that a large number of anchor rods and anchor cables are not removed, the roof at the end of the working face 7 cannot cave in time, forming an arc triangle hanging roof, which has many hidden dangers and threatens the safety and efficient production of the mine. For the geological conditions of the coal mine, the method provided by the present disclosure is used to solve the problem of difficult anchor withdrawal at the end.

Step 1: Prior to the implementation of drilling and grouting operation, in order to guarantee the safety of personnel and equipment during the construction, it is necessary to carry out "wall tapping and roof sounding", to check whether the position of a conveyer is suitable, and migrate the conveyer if the position is unsuitable, and to make the construction area unobstructed within 5 m. Then construction equipment, such as an air duct and grouting pump, is debugged to ensure that the air duct is free from air leakage and blockage, and the parameters such as the lift and rotating speed of the grouting pump are in the normal range. Within 5 m distance from the roof to be treated, a temporary support is erected by means of piling column. The area and position of the temporary support should be appropriate, thus reserving enough operating space for the construction equipment and personnel.

Step 2: During drilling construction operation, three boreholes are provided along the roof between an end support and a coal pillar side. It is designed that the borehole diameter is 65 mm, the spacing between the boreholes is 500 mm, the distance from the borehole starting position to the coal pillar side is 500 mm, the middle borehole is perpendicular to the roof, and the boreholes on both sides are offset by 30 degrees, respectively. The boreholes are continuously charged, the construction is carried out along a roadway strike, the cycle interval is consistent with the daily advancing progress of the working face, and a vertical depth of the borehole is designed to be 10 m. The drilling is started after the borehole starting position is successfully determined. The drilling is started at a low drilling speed, and with the increase of the drilling depth, the drilling speed is adjusted to the optimum speed suitable for roof drilling until a drill rod is in place.

Step 3: The borehole sealing process is carried out with a borehole packer, and the borehole packer is inserted before grouting, and the borehole sealing depth is 0.5 m. In order to ensure the grouting effect and save grouting materials, a flexible plastic sleeve is required to be put in the borehole before the borehole packer is inserted, then the borehole packer is placed into a sleeve. One end of a plastic sleeve is fixed to a thin iron wire, and the iron wire and the plastic sleeve are fed to the bottom of the borehole, and the iron wire and the plastic sleeve are left in the hole. The borehole packer is completely inserted into the borehole, and then a grouting pipeline of the pneumatic grouting pump communicates with an exposed joint of the borehole packer through a tee pipe. Under a certain grouting pressure, a rubber hose of the borehole packer expands to achieve borehole sealing.

Step 4: During anchor withdrawal, the anchor withdrawal is carried out on the hanging roof region of the triangle area at the end of the working face. It is required that the anchor withdrawal rate should reach 85% or more, and a support is required to be strengthened in the arc triangle area if the anchor withdrawal rate does not reach 85%.

Figure 6:
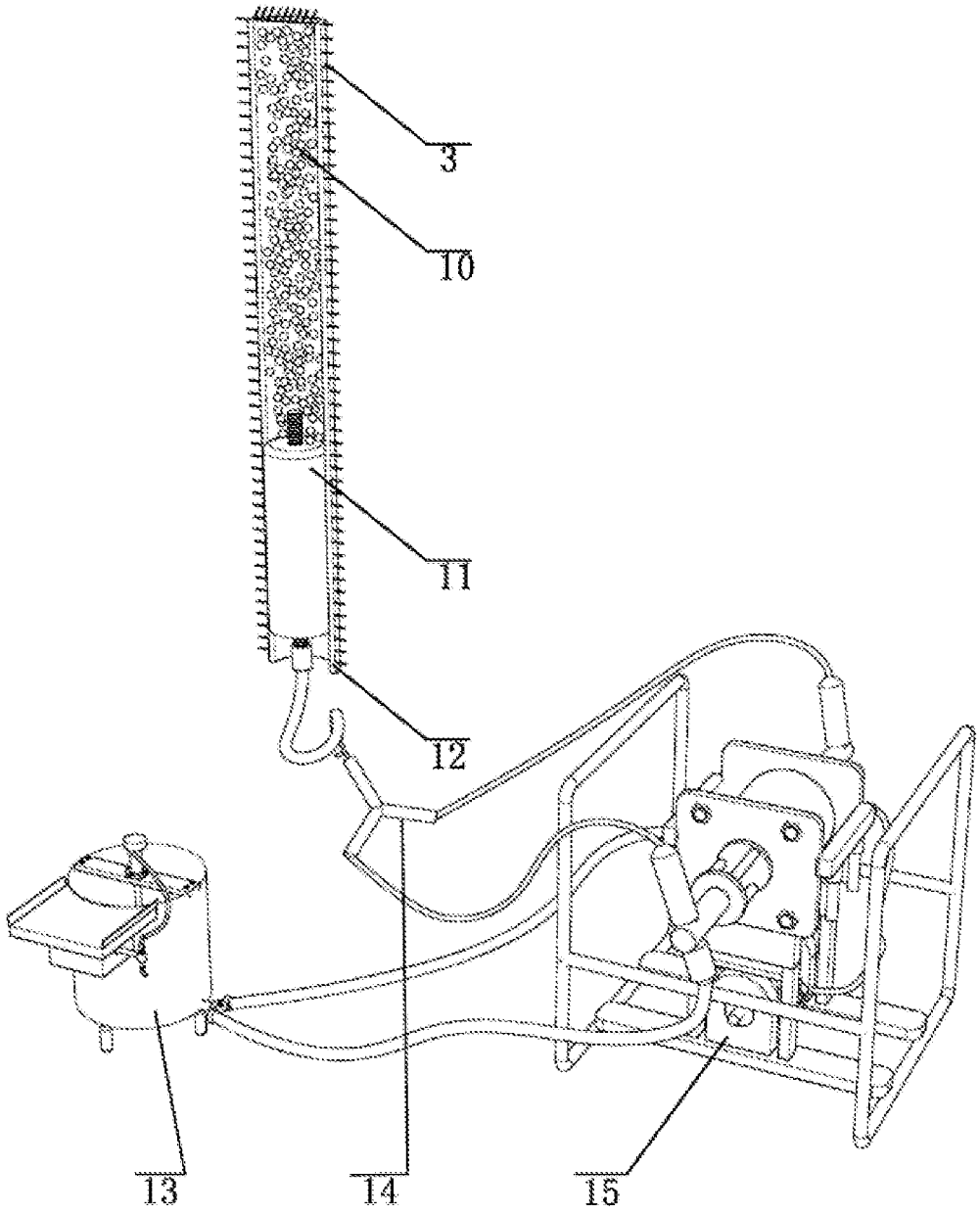
FIG. 6 is a diagram of a static crushing agent technology device.
Figure 7:
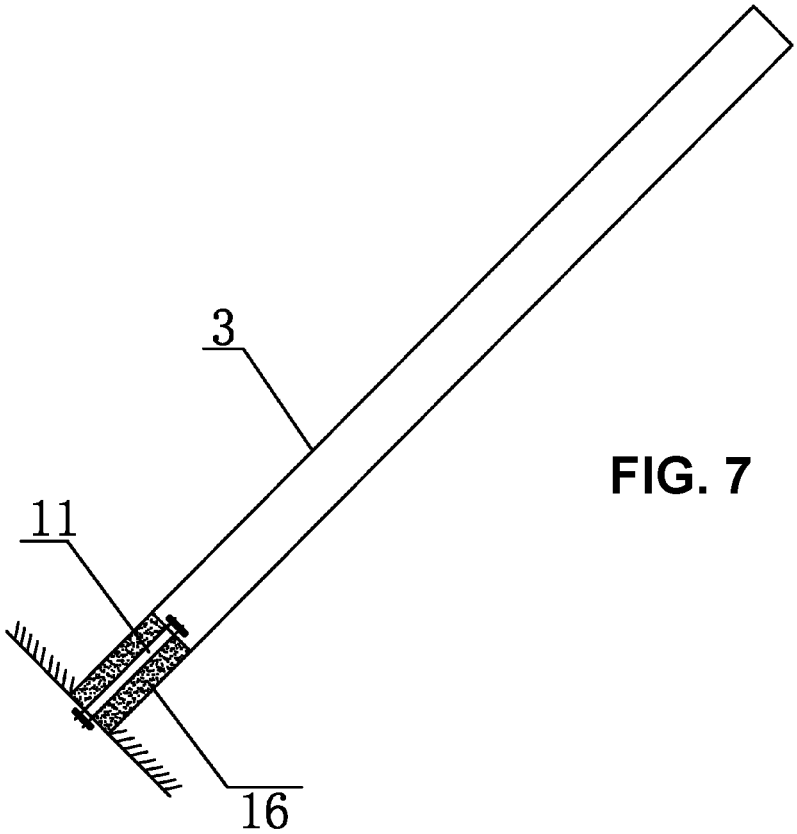
FIG. 7 is a schematic diagram of borehole sealing of a borehole.
Figure 8:
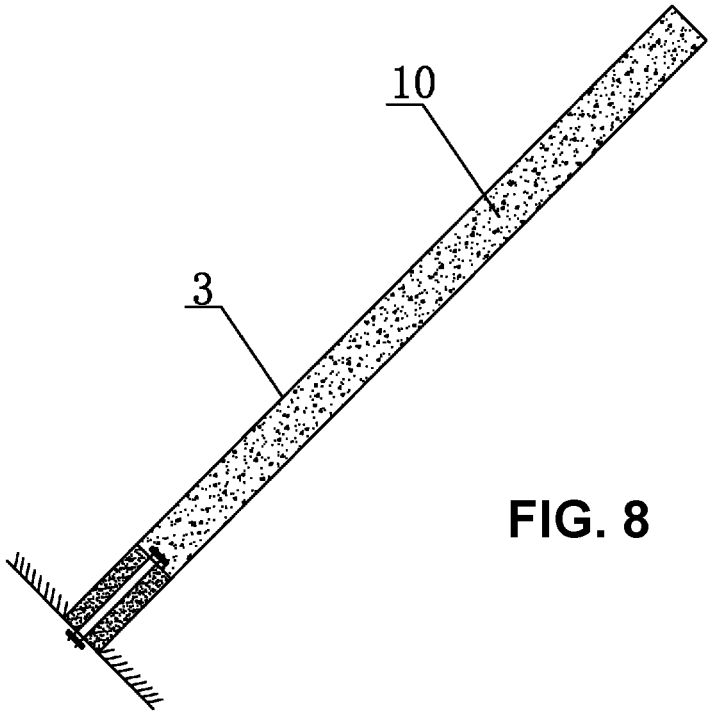
FIG. 8 is a schematic diagram of filling a borehole with a static crushing agent.
Figure 9:
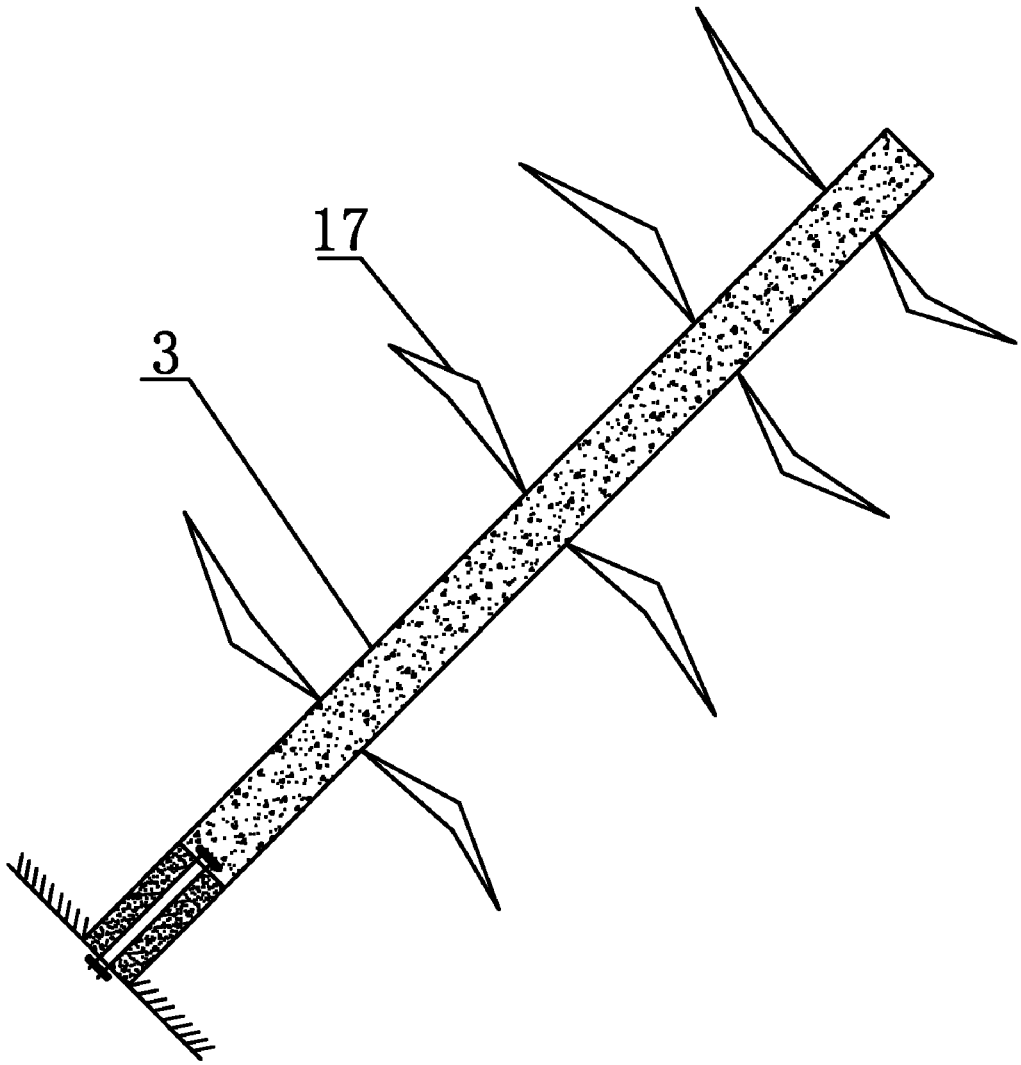
FIG. 9 is a schematic diagram of crack propagation of a borehole.
Figure 10:
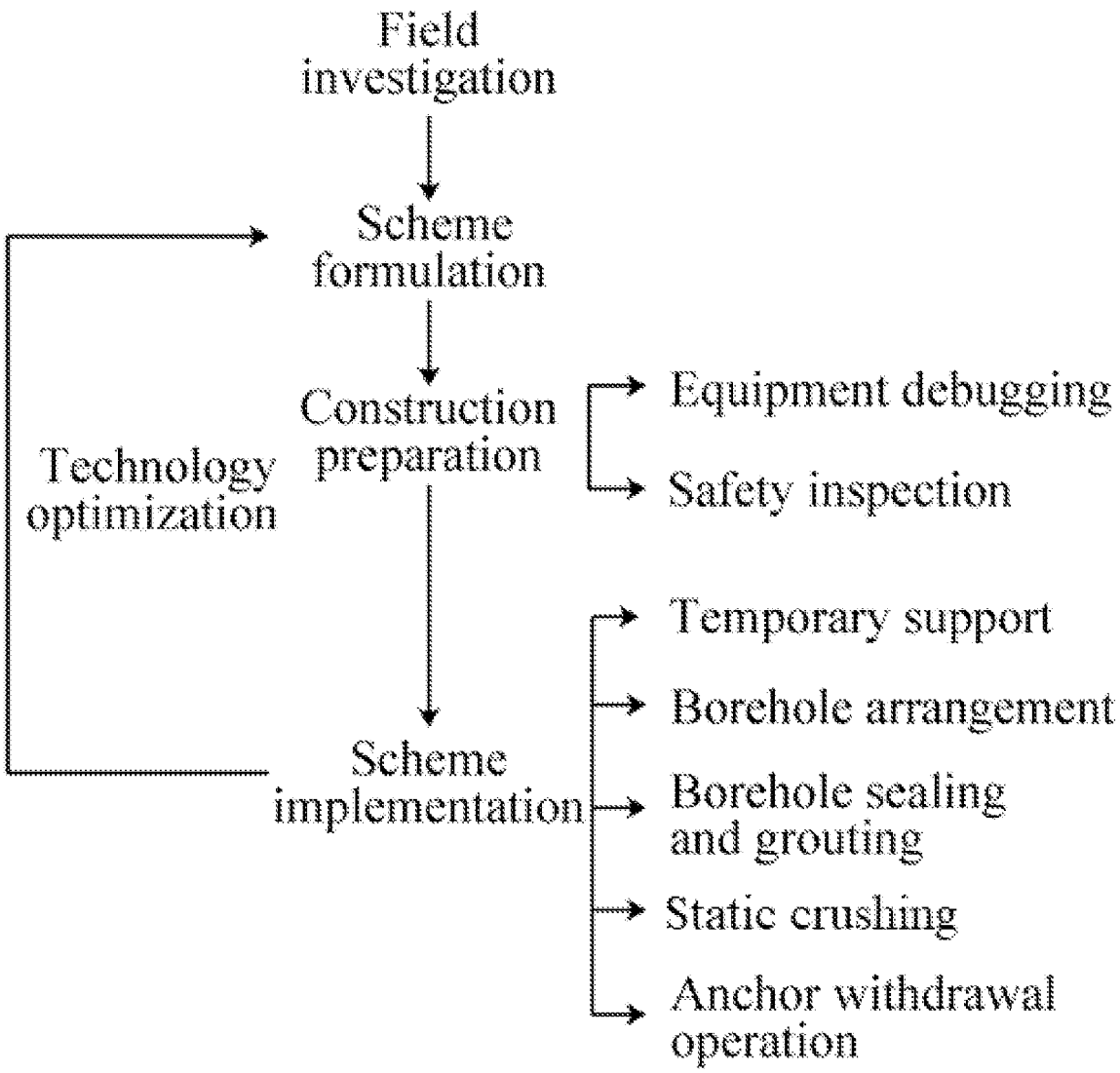
FIG. 10 is a flow chart of a static crushing anchor withdrawal technology.

Step 5: The static crushing agent grouting technology construction is as shown in FIG. 6, and the static crushing agent and water are prepared into a slurry according to a water-cement ratio of 1:3. A quantity of clean water is added to a stirring barrel, then a corresponding mass of static crushing agent is added to the water, and finally the water and the static crushing agent are stirred into a uniform paste. Stirring should be rapid, and it should be ensured that the slurry stirred at one time can be pumped continuously within 10 min to 15 min without interruption. Prior to pumping and filling the static crushing agent slurry in the borehole, the inner cavity of the borehole must be cleaned (purged with high-pressure air), and no water and sundries are allowed in the borehole. For dry rock boreholes with strong water absorption capacity, it is necessary to ensure that the borehole wall has enough humidity, but accumulated water cannot exist in the borehole cavity.

Figure 4:
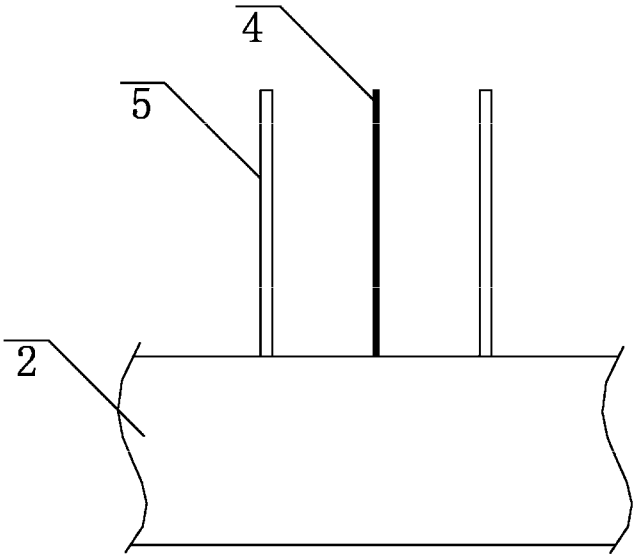
FIG. 4 is a sectional view of a section II-II in FIG. 2.
Figure 5:
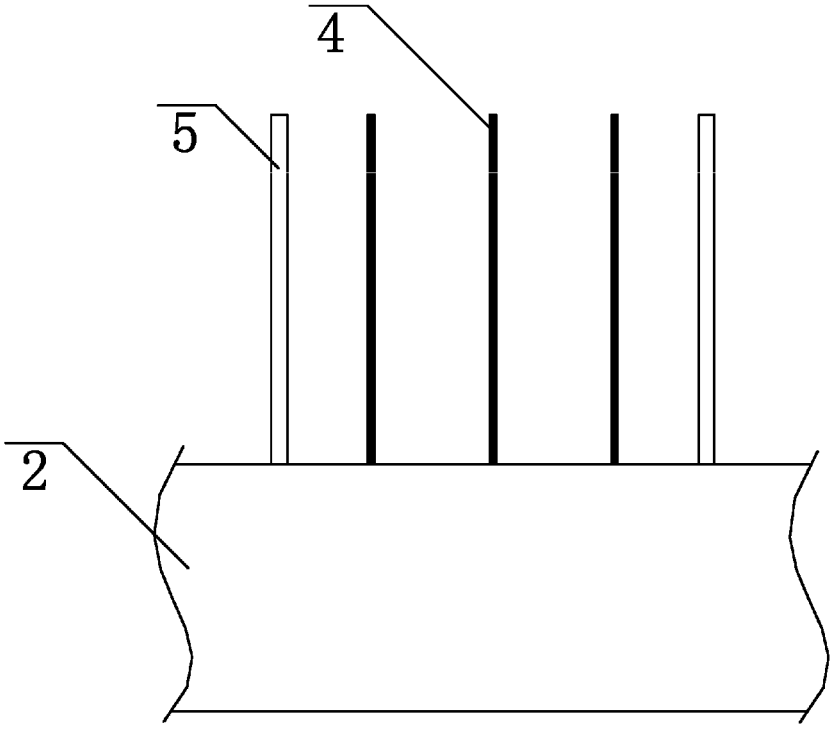
FIG. 5 is a sectional view of a section III-III in FIG. 2.

Step 6: As shown in FIG. 4, during the use of a double-liquid grouting pump, a filter screen should be provided at a slurry suction port to prevent caking impurities, paper bags and other sundries from entering the slurry. The pressure increase of a pressure gauge should be watched carefully during the pumping, thus adjusting the pump flow rate in time. The pump should be stopped in time when the pressure exceeds 6 MPa to identity and handle the reasons. If the grouting needs to be suspended during pumping, a quantity of clear water should be pumped into the borehole to keep a grouting channel unblocked. During pumping and charging, attention should be paid to the rotating conditions of the pump and the suction and discharge of slurry. After each grouting, the pipelines and machines should be flushed with clear water and inspected and maintained in time.

Step 7: During the construction, a small amount of punching may be caused due to various reasons, and thus the field operators are required to wear protective glasses (i.e., dust-proof and impact-proof PVC goggles), and it is forbidden to look up below the borehole after grouting. During the reaction of the static crushing agent, in order to prevent injury to underground passing personnel, special personnel should be assigned to set up warning signs at the positions 10 m in front and behind both ends of the construction area, and to monitor the reaction of the static crushing agent on site. If cracks are found and rocks fall off, personnel should be prohibited from passing immediately.

Step 8: After the above steps are completed, the temporary support is removed, this cycle is finished, and the above steps are repeated in the next cycle. After the reaction of the static crushing agent, the rocks around the borehole produce radial cracks, and a structural weak plane is formed between the boreholes on the roof, and thus the hanging roof in the triangle area can cave in time to reduce the influence on mining and ensure the normal production efficiency of the working face.

What is claimed is:

1. A method of static crushing directional anchor withdrawal at the end of a large-mining-height working face, comprising the following steps:

step 1: designing parameters of boreholes for static crushing borehole position, wherein the boreholes are located in a triangle area of a roof end, arranged around an anchor cable, and provided along a gateway strike;

borehole diameter: wherein the borehole diameter is from 48 mm to 65 mm;

borehole angle: wherein the borehole is perpendicular to the roof;

borehole depth: wherein the depth is consistent with the length of a roof anchor cable;

analyzing a spacing between boreholes: according to the propagation range of wall rock cracks when a static crushing agent acts, determining a spacing between the boreholes:

step 2: designing parameters of grouting technology of the static crushing agent, wherein a water-cement ratio of the static crushing agent is 1:3;

the mass of the static crushing agent required for each borehole is calculated according to the following formula:

$$Q = K\pi\gamma\left(\frac{\Phi}{2}\right)^2(s - s_1),$$

wherein K is a grouting coefficient 1.4-1.5, $\gamma$ is the bulk density of the material, g/cm$^3$, $\Phi$ is the borehole diameter, m, s is the borehole depth, m, $s_1$ is borehole sealing length, m, and Q is the mass of the crushing agent for each borehole, Mg (Mega-grams);

the static crushing agent is grouted by a pneumatic double-liquid grouting pump, with the use of a tee pipe;

a borehole packer is selected from one having a diameter of 50 mm, the borehole sealing range of 55 mm to 100 mm, and a working pressure of 5 MPa to 7 MPa, or the borehole packer having a diameter of 38 mm, the borehole sealing range of 43 mm to 55 mm, and a working pressure of 5 MPa to 7 MPa;

the static crushing agent is stirred with a stirring barrel, wherein the stirring barrel has the capacity of 80 L, a rated air pressure of 0.6 MPa, a blade torque of 150 N·m, length×width×height of 0.5 m×0.5 m×1.0 m, and a weight of 120 kg;

step 3: carrying out the static crushing agent grouting technology, comprising the following steps:

a: prior to drilling and grouting operation, tapping wall and sounding roof, checking whether the position of a conveyer is suitable, and migrating the conveyor if the position is unsuitable; and making a construction area unobstructed within the 5 m;

debugging an air duct and the grouting pump to ensure that the air duct is free from air leakage and blockage, and that the lift and rotating speed of the pneumatic grouting pump are in the normal range;

b. erecting a temporary support by means of piling column within 5 m distance from the roof to be treated, and after erecting the temporary support, drilling on the roof according to the design scheme in step 1;

c. carrying out borehole sealing technology by using a borehole packer, with a borehole sealing depth of 0.5 m; placing a flexible plastic sleeve in the borehole, placing the borehole packer in the plastic sleeve, and completely inserting the borehole packer into the borehole, and connecting a grouting pipeline of the pneumatic grouting pump to an exposed joint of the borehole packer, and enabling a rubber hose of the borehole packer to expand to achieve borehole sealing;

d. mixing water and the static crushing agent according to a weight ratio of 1:3, stirring the mixture of the water and the static crushing agent with the stirring barrel to form a uniform slurry with fluidity, and filling the borehole with the slurry within 10 min; and step 4, carrying out an anchor withdrawal operation, and withdrawing anchor rods and anchor cables in an arc triangle area of the roof at the end.

2. The method of claim 1, wherein in the borehole position arrangement in step 1, when two anchor cables are provided in the same row, four static crushing agent charging boreholes are arranged in front and behind the anchor cables, and an auxiliary borehole is provided between the two anchor cables; and when three anchor cables are provided in the same row, four static crushing agent charging boreholes are arranged in front and behind the anchor cables, and an auxiliary borehole is provided on each of both sides close to a coal wall.

3. The method of claim 1, wherein in the step of drilling on the roof in step 3, the drilling is started at a low drilling speed, and with the increase of the borehole depth, the drilling speed is adjusted to the optimum speed suitable for roof drilling until a drill rod is in place; and before the drill rod descends to leave the hole, a protective handrail is held by another person to ensure the stability of a drilling rig, and then the drill rod is replaced with a second drill rod to complete final drilling.

4. The method of claim 1, wherein a slurry suction port of the pneumatic grouting pump is provided with a filter screen.

5. The method of claim 1, wherein in the static crushing agent grouting technology in step 3, the single borehole is charged at one time, and the boreholes in the same row are charged at the same time.

* * * * *